United States Patent [19]

Villa-Real

[11] 4,345,541

[45] Aug. 24, 1982

[54] MONO-RINGED ROTATORY MEDICATION REMINDER

[75] Inventor: Antony-Euclid C. Villa-Real, Las Vegas, Nev.

[73] Assignee: Medi-Timer Corporation, Las Vegas, Nev.

[21] Appl. No.: 120,871

[22] Filed: Feb. 12, 1980

[51] Int. Cl.[3] ..... B65D 5/72; G09F 9/00

[52] U.S. Cl. ..... 116/308; 206/459; 206/534; 368/89

[58] Field of Search ..... 116/308; 215/219, 228, 215/365

[56] References Cited

U.S. PATENT DOCUMENTS

| | | | |
|---|---|---|---|
| Re. 22,570 | 11/1944 | Lux | 116/308 X |
| 2,739,564 | 3/1956 | North | 116/308 |
| 2,817,451 | 12/1957 | Giles et al. | 116/308 X |
| 3,263,647 | 8/1966 | Murphy et al. | 116/308 X |
| 3,921,568 | 11/1975 | Fish | 116/308 |
| 4,002,258 | 1/1977 | Curry | 215/219 X |

FOREIGN PATENT DOCUMENTS

| | | | |
|---|---|---|---|
| 163309 | 6/1949 | Austria | 116/308 |
| 1937 of 1894 | | United Kingdom | 116/308 |

*Primary Examiner*—Daniel M. Yasich

*Attorney, Agent, or Firm*—Sughrue, Mion, Zinn, Macpeak & Seas

[57] ABSTRACT

A simple mechanically manipulatable two-component inter-acting device for use as an effective medication-time-intake reminder having an attachable-detachable outer rotatory ring with either a singular or a plurality of outer protrusions for easy clockwise turning purposes in relation to a correspondingly engageable stationary component having a flat circularly running clocklike numeral indicia that are equally interspaced between each succeeding numerals ranging from 1 to 12 is disclosed. Each respective rotatory ring has fixed clockwise spacing interval between the "LAST DOSE" arrow indici a and the "NEXT DOSE" arrow indicia depending upon the required application to accomplish the specific time interval in the administration of each corresponding particular medication. For functional effectivity it is preferred that each kind of rotatory ring for each respective time-interval application be differentially color-coded to easily distinguish one from the others.

4 Claims, 70 Drawing Figures

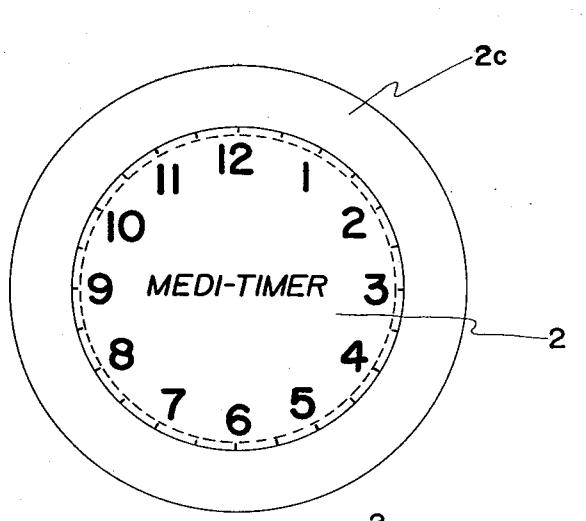
FIG. 1
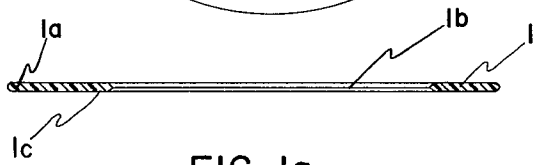
FIG. 1a
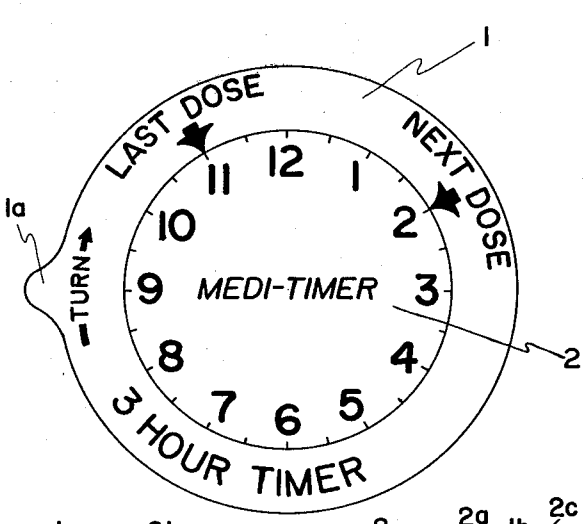
FIG. 2
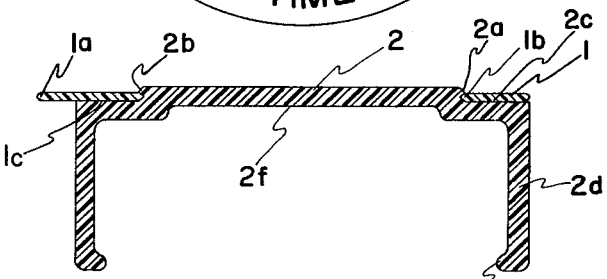
FIG. 2a
FIG. 3
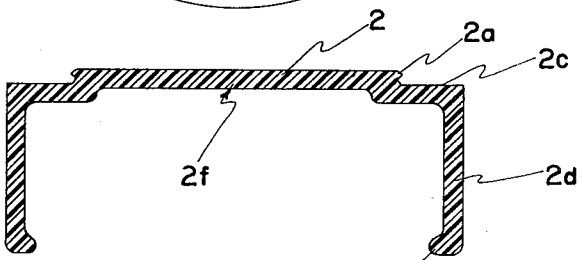
FIG. 3a FIG. 28
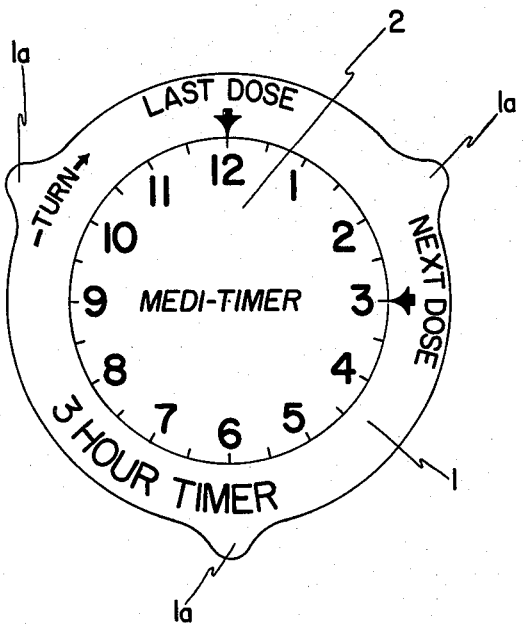
FIG. 29
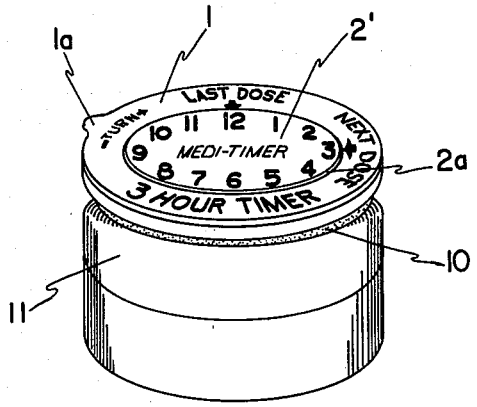
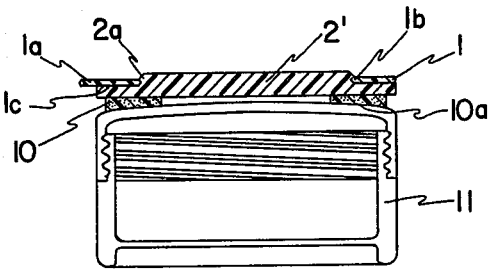
FIG. 30
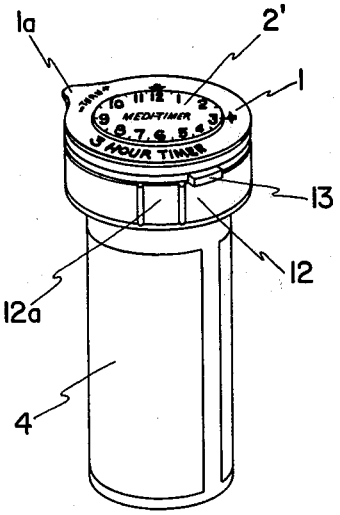
FIG. 31
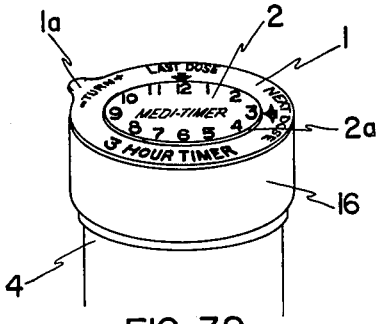
FIG. 32
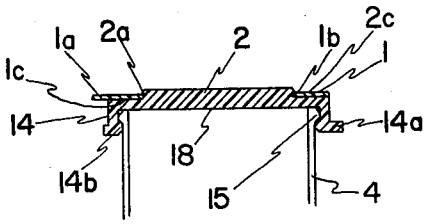
FIG. 34
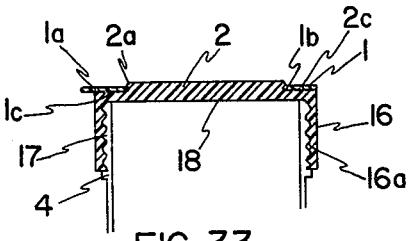
FIG. 33

MONO-RINGED ROTATORY MEDICATION REMINDER

BACKGROUND OF THE INVENTION

It is of utmost importance to provide to hospitals, pharmacies and individual homes around the world with a simple, economical and easy to manipulate medication-time-intake reminder for effective use by medical professionals assisting their patients, friends and relatives helping the patients, and, for optimal aid to patients themselves in the proper administration of both singular and multiple medications that are scheduled to be taken at different time intervals involving both prescription and non-prescription drugs. It is also important to have the abovementioned reminder handy for use by travelers as well as for use by office personnel during the administration of various medications involving different time-intervals. However, this need in this area of mass-application has not yet been properly solved and made available in the market for use by the general public as well as by professionals on a worldwide scale.

Several patents have been filed in the U.S. Patent Office in an effort to solve this human therapeutic need. However, the ones that have been issued such as U.S. Pat. Nos. 493,851, 535,610; 576,833; 557,616, 619,078; 623,171; 1,129,384; 1,211,737; 2,042,351; 2,066,183; 2,111,637; 2,565,095; 3,446,179 are structurally and mechanically more complicated. U.S. Pat. Nos. 2,450,949; 2,739,564; 2,767,680; 2,706,464; 3,739,740; 3,960,713 are structurally different, and, comparatively less effective than the instant invention, as far as the overall combination of simplicity, functional completeness, ease of operation, economy in mass-production, ease in dispensing and aesthetics are concerned.

SUMMARY OF THE INVENTION

The main object of the present invention is to provide an effective two-component medication-time-intake reminder that can be economically mass-produced, distributed, stored and marketed. Another object is to provide a simple structural design that can bring forth ease of operation by the user while at the same time solving the common confusion especially arising during the usage of multiple medications with a variety of time-interval administration to the patient.

The instant invention includes among its objects to positively enable indication of the time at which the last and next dose of medicine was and is to be taken. Such function is achieved by the relative placement of the outer rotatably moveable time-interval indicator with respect to the inner clock-like face. Thus, by selectively orienting the former with respect to the latter, the user will readily observe when the next dose should be taken.

Basically, the present device consists of two main components, an outer rotatory ring which can be rotated in a clockwise manner, and, a stationary component which contains numerical indicia ranging from 1 to 12 and, arranged in a regular clockwise fashion; each successive numerical indicia being equally interspaced between each other. The said ring component is provided with singular or multiple outer protrusions for usage as turning tab portions of the said rotatory ring. The word "TURN" is marked just below the said turning tab portion with a corresponding arrow indicia directed in a clockwise manner. There are several varieties of functional capabilities involved in each kind of rotatory ring depending upon the particular use relevant to the set medication time-intake intervals are concerned. For example, there are differences in the indicia on the face of each of the particular rotatory rings; a "3-HOUR TIMER" rotatory ring having the "LAST DOSE" indicia with its corresponding inwardly pointed arrow indicia interspaced in a three-hour clockwise interval in relation to the "NEXT DOSE" indicia coordinated with its corresponding arrow indicia; a "4-HOUR TIMER" having the "LAST DOSE" indicia with its corresponding arrow interspaced in the four-hour clockwise interval in relation to the "NEXT DOSE" indicia coordinated with its corresponding arrow; a "6-HOUR TIMER" having the "LAST DOSE" indicia with its corresponding arrow indicia interspaced in a six-hour clockwise interval in relation to the "NEXT DOSE" indicia coordinated with its corresponding arrow; an "8-HOUR TIMER" having the "LAST DOSE" indicia with its corresponding arrow interspaced in an eight-hour clockwise interval in relation to the "NEXT DOSE" indicia coordinated with its corresponding arrow. In the "12 & 24-HOUR TIMER", only the "NEXT DOSE" indicia with its corresponding arrow appears, and the "LAST DOSE" markings omitted.

In actual operation, since the said ring can be engaged in firm but rotatory interrelationship with the stationary clocklike component mentioned above, the mere differences in each particular clockwise spacing interval between the "LAST DOSE" and the "NEXT DOSE" depending upon whether the rotatory ring is for a "3-HOUR TIMER", a "4-HOUR TIMER", "6-HOUR TIMER", and an "8-HOUR TIMER", will bring forth a correspondingly fixed shifting of the various "LAST DOSE" arrow indicia and the "NEXT DOSE" arrow indicia in relation to the clocklike stationary component when said ring is rotated in a clockwise fashion. In other words, if an individual is using a "3-HOUR TIMER", since the clockwise spacing between the "LAST DOSE" arrow indicia and the "NEXT DOSE" arrow indicia is fixed, it is, therefore, possible that when the "LAST DOSE" arrow indicia appears directed toward eleven o'clock, the "NEXT DOSE" for that medication becomes automatically set at two o'clock as indicated by the "NEXT DOSE" arrow indicia, and, when two o'clock comes and that particular medication is taken, the user simply turns the rotatory "3-HOUR TIMER" ring clockwise thus setting the "LAST DOSE" arrow indicia at two o'clock and then the "NEXT DOSE" arrow indicia becomes automatically set at five o'clock, and the operation continues in the same fashion of set time-interval shifting as long as the user is using the said "3-HOUR TIMER" and is taking that particular medication. A "4-HOUR TIMER" rotatory ring having the "LAST DOSE" arrow indicia directed at eleven o'clock automatically sets the "NEXT DOSE" arrow indicia at three o'clock, and, when three o'clock comes and the user takes that particular medication contained therein, he simply shifts the said rotatory ring clockwise, aligning the "LAST DOSE" arrow indicia at three o'clock and automatically shifting the "NEXT DOSE" arrow indicia at seven o'clock, and, the process can continue as long as the user is using that particular medication with a "4-HOUR TIMER". A "6-HOUR TIMER" rotatory ring having the "LAST DOSE" arrow indicia pointed at eleven o'clock will have the "NEXT DOSE" arrow indicia pointing at five o'clock, and, when the latter time comes, and he takes the medication contained therein, he simply turns the said rotatory "6-HOUR TIMER" ring clockwise, aligning the "LAST DOSE" arrow indicia to five o'clock and thereby automatically setting the "NEXT DOSE" arrow indicia to eleven o'clock, and, again the process can go on in a similar fashion as long as he is using that particular "6-HOUR TIMER". The "8-HOUR TIMER" having the "LAST DOSE" arrow indicia pointing at eleven o'clock will have the "NEXT DOSE" arrow indicia pointing at seven o'clock, and, when seven o'clock comes, after taking that particular medication contained therein, he simply rotates the said "8-HOUR TIMER" rotatory ring clockwise, aligning the "LAST DOSE" arrow indicia to seven o'clock, thereby automatically adjusting the "NEXT DOSE" arrow indicia to three o'clock, and, again the process continues in the same fashion in a clockwise direction as long as the said "8-HOUR TIMER" is being used. However, in the case of the "12 and 24-HOUR TIMER" as explained earlier, it has only the "NEXT DOSE" indicia with its corresponding arrow indicia printed, and, therefore, if the user is taking medication on a "12-HOUR" interval and begins taking that particular medication at eleven o'clock, he does not have to turn the rotatory ring if the "NEXT DOSE" arrow indicia has already been set at eleven o'clock; he simply waits for eleven o'clock and takes that particular medication. However, if the user is taking medication on a "24-HOUR" interval and the "NEXT DOSE" arrow indicia has already been set at eleven o'clock, again, he does not have to turn the said rotatory "12 & 24-HOUR TIMER" ring, but then he will have to wait until the "24-HOUR" time has elapsed before taking that particular medication again. In order to differentiate in a more effective way between "3-HOUR TIMER", "4-HOUR TIMER", "6-HOUR TIMER", "8-HOUR TIMER" and "12 & 24-HOUR TIMER" it is preferrable to make contrast color codings in each individual rotatory rings respectively. For example, the color coding designated for a "3-HOUR TIMER" rotatory may be red, "4-HOUR TIMER" rotatory ring with a contrasting color such as yellow, and the "6-HOUR TIMER" rotatory ring may be colored green, and "8-HOUR TIMER" rotatory ring may be colored orange and a "12 & 24-HOUR TIMER" rotatory ring may be colored blue. It is to be understood that these preferred color codings mentioned above are only serving as examples and not absolute designation of color codings in each respective rotatory timer rings. Other colors can be used to differentiate color contrast that can be effective for both professionals and consumer use.

Each of the various rotatory rings can be used in conjunction with the proper mating structures of the stationary component of the invention; each could be applied to a corresponding mating stationary component that can be glued or adhesively attached on top of existing medicine cap, pill box and on the flat surface of medicine bottle, others of an alternative design can be engaged with a corresponding mating stationary component that can be attached firmly over existing medication caps and still others of yet another alternative design can be directly attached to a corresponding stationary mating component usable as a total replacement to existing medicine caps.

BRIEF DESCRIPTION OF THE ILLUSTRATIVE DRAWING

FIG. 1 is a top elevational view of the rotatory "3-HOUR TIMER" ring having the various indicia markings on its face.

FIG. 1*a* is a cross sectional view of the said "3-HOUR TIMER" rotatory ring cut at its widest circumference including the section of the turning tab as shown in FIG. 1.

FIG. 2 is an elevational view of the "3-HOUR TIMER" with the "3-HOUR TIMER" rotatory ring showing the corresponding information indicia on its face and engaged in conjunction with the stationary component of the invention having clocklike numeral markings ranging from 1 to 12 that are equally interspaced between each other in a clockwise direction.

FIG. 2*a* is a cross-sectional view of the rotatory ring engaged with the sectional structure of the stationary component as shown on FIG. 2 cut across its widest circumference. This drawing also shows the section of the lateral depending walls of the stationary component of the invention that can fit in firm gripping action over an existing medicine cap of corresponding size. The turning tab of the rotatory ring is also shown protruding horizontally to the left.

FIG. 3 is a top elevational view of the stationary component having clocklike numeral markings ranging from 1 to 12, each numeral markings equally interspaced between each other in a clockwise direction.

FIG. 3*a* is the sectional view of FIG. 3 cut at its widest diameter. This drawing also shows the lateral wall in section of the said stationary component that can fit or grip over the existing medicine plastic caps.

Figure 4:
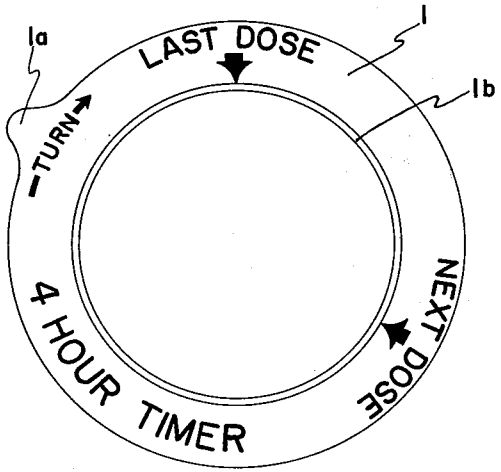
FIG. 4 is a top elevational view of the "4-HOUR TIMER" rotatory ring showing all the proper indicia and showing in the inner section the circularly running ridge.
Figure 4A:
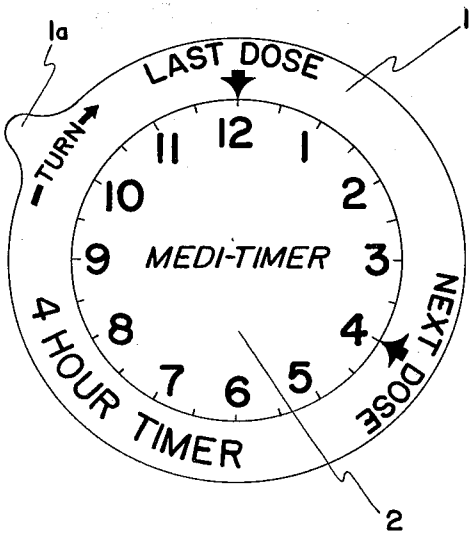

FIG. 4*a* is a top elevational view of the "4-HOUR TIMER" showing the "4-HOUR TIMER" rotatory ring with its indicia markings and shown as properly engaged with the inner circular clocklike face of the stationary component.

Figure 5:
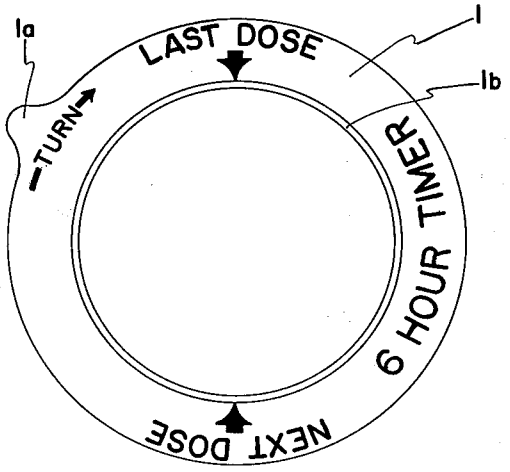
FIG. 5 is a top elevational view of the "6 HOUR TIMER" rotatory ring with all the indicia markings on its face. It also shows the inner circularly running ridge.
Figure 5A:
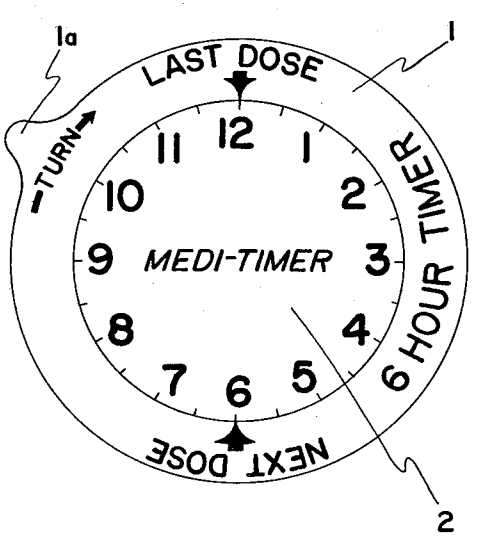

FIG. 5*a* is a top elevational view of the "6-HOUR TIMER" with the "6-HOUR TIMER" rotatory ring engaged with the corresponding inner circular clocklike face of the stationary component. All indicia markings are also shown.

Figure 6:
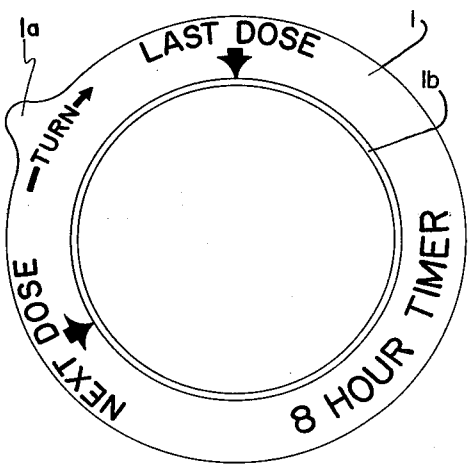
FIG. 6 is a top elevational view of the "8-HOUR TIMER" rotatory ring showing the same said ridge and all the proper indicia markings on its face.
Figure 6A:
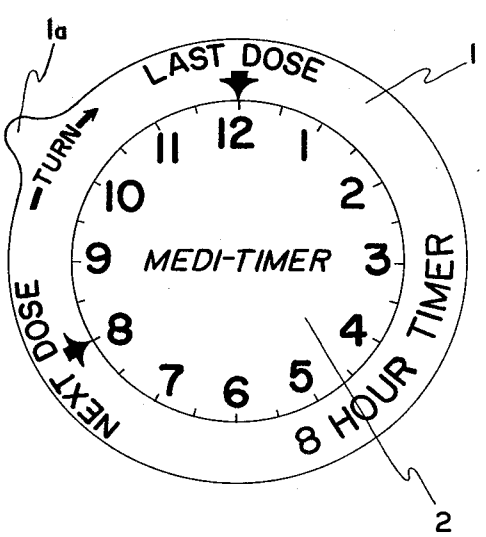

FIG. 6*a* is a top elevational view of the "8-HOUR TIMER" with all indicia markings shown in both the engaged "8-HOUR TIMER" rotatory ring and the corresponding inner circular clocklike face of the stationary component.

Figure 7:
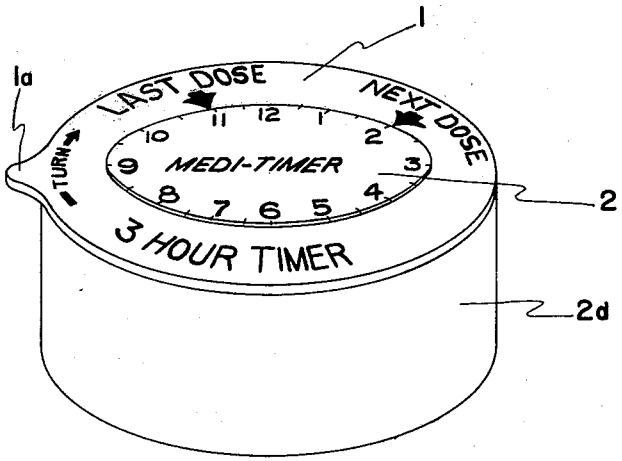

FIG. 7 is a perspective view of the "3-HOUR TIMER" showing an inclined top and side view combination and showing the properly engaged "3-HOUR TIMER" rotatory ring and the corresponding inner circular clocklike face of the stationary component having annular wall.

Figure 8:
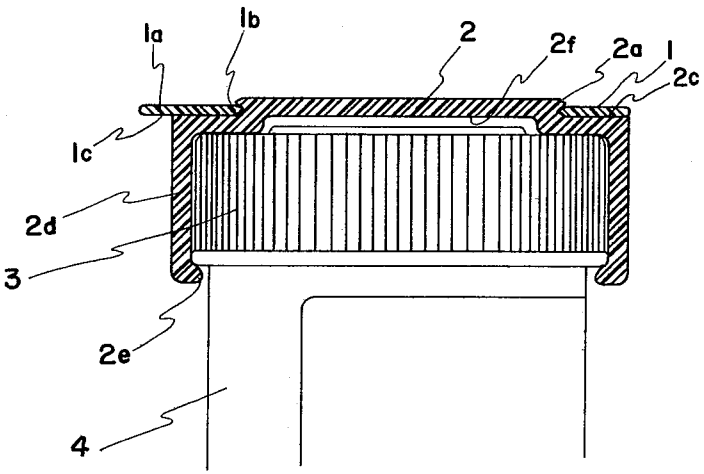

FIG. 8 is a combination of the sectional view of the said medication-time-intake reminder shown in correct engaging relationship over the present existing medicine cap as shown in a side elevational view covering the corresponding medication container.

Figure 9:
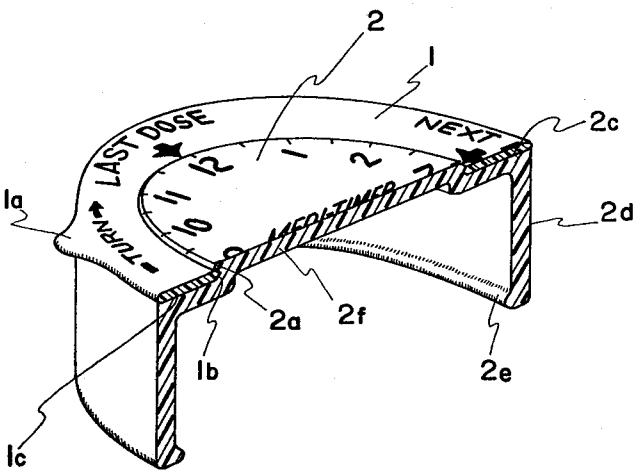

FIG. 9 is a perspective view of the "3-HOUR TIMER" favoring an inclined top and side view combination but cut straightly across the widest diameter thereby showing the sectional view of both the said rotatory ring and the stationary component including part of the corresponding annular wall with inner gripping edges.

Figure 10:
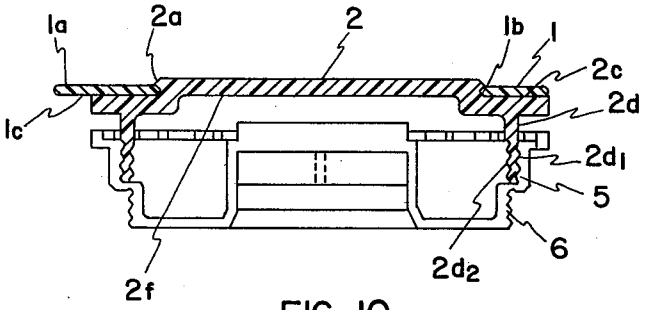

FIG. 10 is a cross section of the medication-time-intake reminder showing part of the cut section of the rotatory ring and the cut section of the stationary component having modified inner and outer screw portion of the annular wall in proper engagement with another kind of currently used reversibly applicable existing medication cap.

Figure 11:
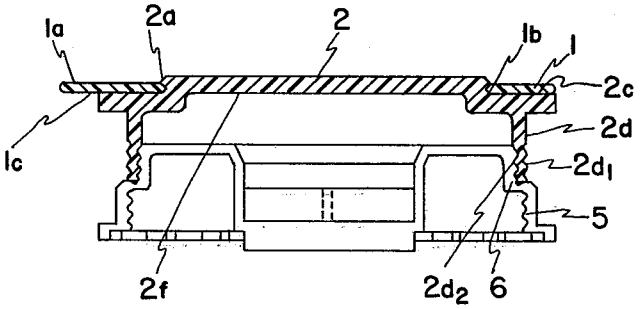

FIG. 11 shows the same sectional view of the same kind of modified medication-time-intake reminder in proper engagement with the reversed side of the said currently used reversibly applicable medicine cap as shown in FIG. 10.

Figure 12:
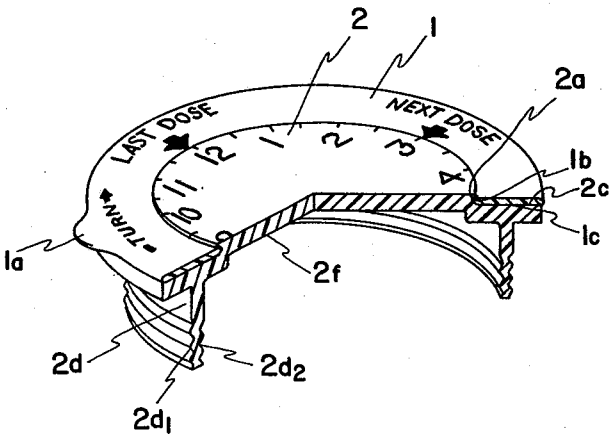

FIG. 12 is a combination of inclined top view and side view of the same modified version of the invention which has been partly cut in an obtuse angle from the center exposing the sectional view of the rotatory ring and the stationary component.

Figure 13B:
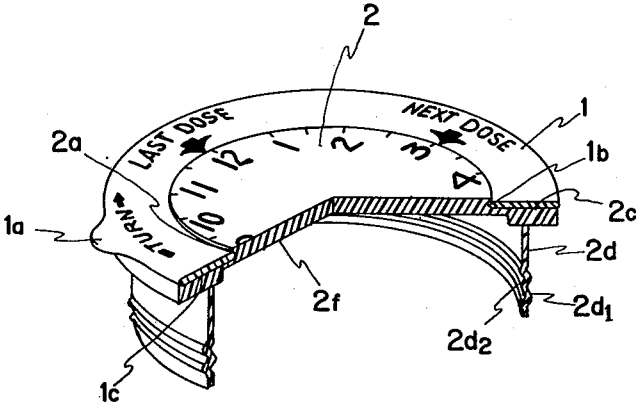
Figure 13A:
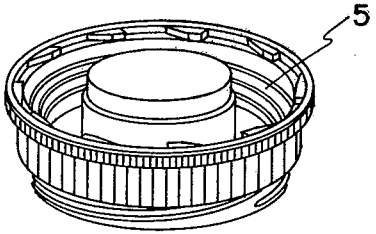
Figure 13:
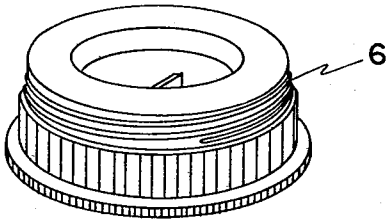

FIG. 13 is a perspective view of the same currently used reversibly applicable medicine cap as shown in FIG. 11.

FIG. 13*a* is a perspective view of the reversed side of the same currently used reversibly applicable medicine cap shown in FIG. 13.

FIG. 13*b* is a similar view as shown in FIG. 12 only that the annular wall is taller than that of the annular wall shown in FIG. 12.

Figure 14B:
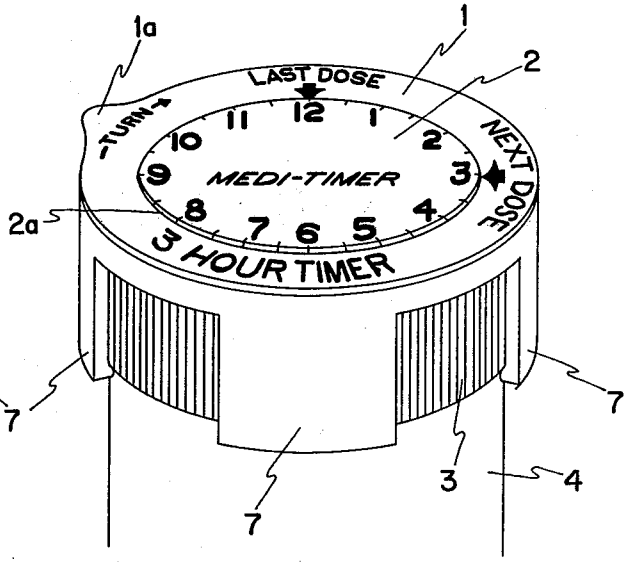
Figure 14A:
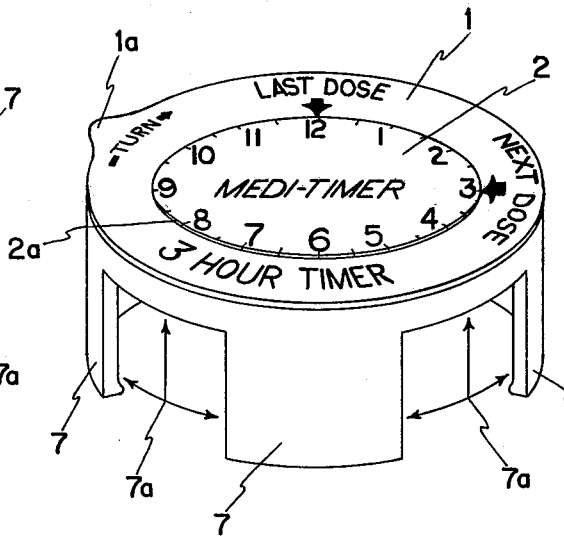
Figure 14:
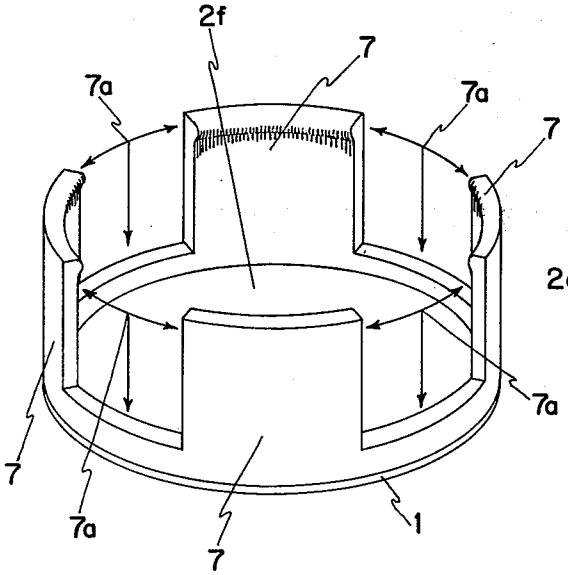

FIG. 14 is a perspective view of another modified type of the medication-time-intake reminder cap showing the device in an upside down fashion and illustrating the four equally interspaced walls of the stationary component.

FIG. 14*a* is a perspective view of the combination of top and side views of the same modified version as shown in FIG. 14.

FIG. 14*b* is the same perspective view of the medication-time-intake reminder cap as shown in FIG. 14*a* in proper firm and gripping engagement over and around the existing medicine cap that covers the medicine container.

Figure 15:
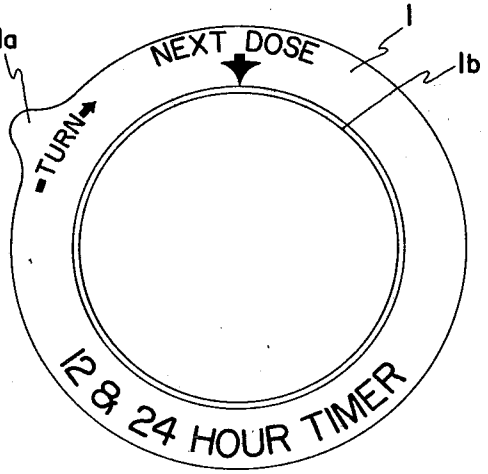

FIG. 15 is a top elevational view of the "12 & 24-HOUR" rotatory ring showing the various relevant indicia.

Figure 15A:
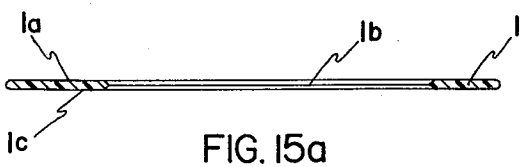

FIG. 15*a* is a sectional view of the same rotatory ring shown on FIG. 15.

Figure 16:
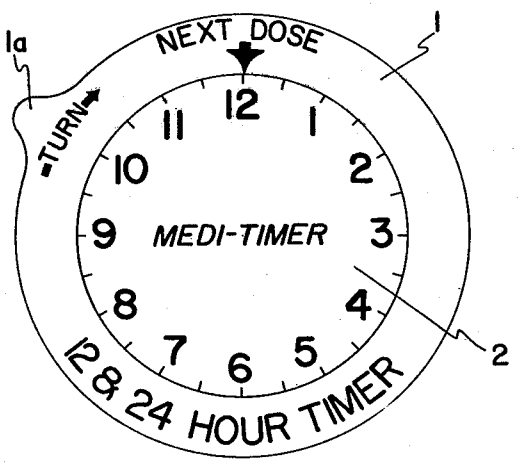

FIG. 16 is a top elevational view of the "12 & 24 HOUR" rotatory ring in proper engagement with the stationary component of the device.

Figure 16A:
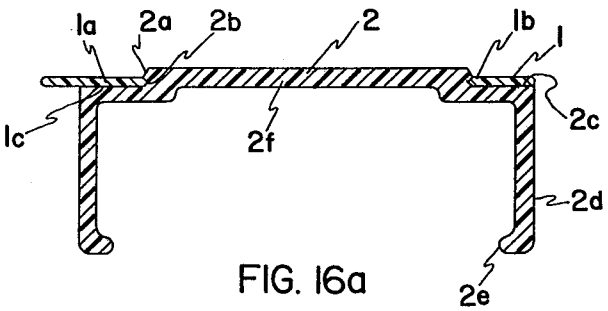

FIG. 16*a* is a sectional view of the same device cut across the widest diameter running through the turning tab of the ring and showing the annular wall and the gripping portion of the wall.

Figure 17:
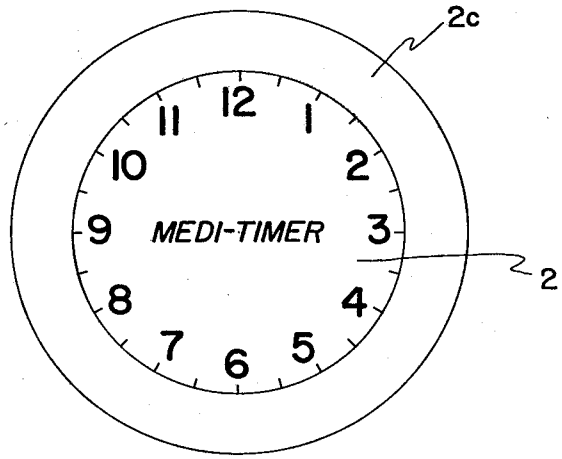

FIG. 17 is a top elevational view of the stationary component with the inner circularly running clocklike numeral indicia which are properly interspaced with each other in a successive manner.

Figure 17A:
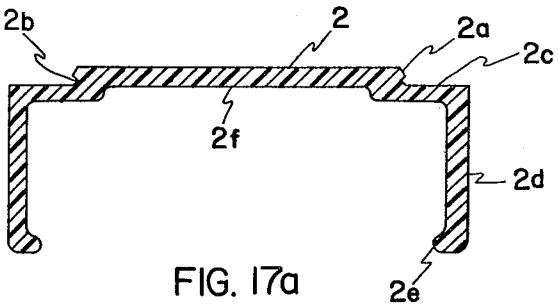

FIG. 17*a* is a sectional view of the same stationary component as shown in FIG. 17 and cut across its widest diameter and illustrates the wall with its gripping portion.

Figure 18:
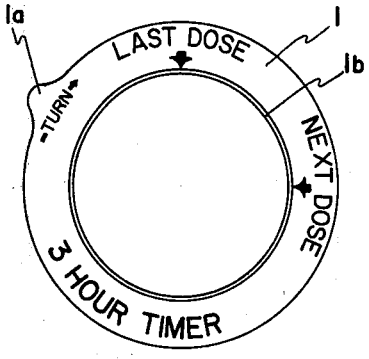

FIG. 18 is a top elevational view of the "3-HOUR TIMER" rotatory ring with its necessary indicia in proper placement.

Figure 18A:
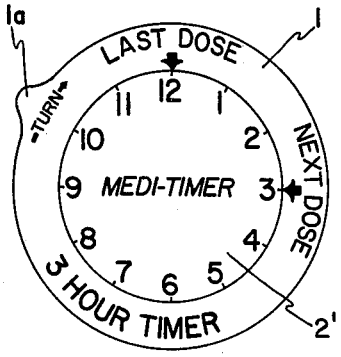

FIG. 18*a* is a top elevational view of the same rotatory ring in proper engagement with the stationary clocklike component of the invention.

Figure 18B:
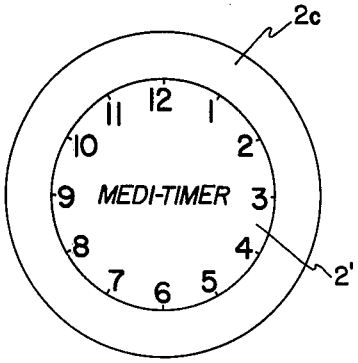

FIG. 18*b* is a top elevational view of the stationary component of the invention showing the top inner circular face having clocklike numeral indicia ranging from 1 to 12.

Figure 18C:
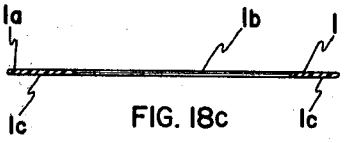

FIG. 18*c* is a sectional view of the same rotatory ring as shown in FIG. 18 and cut at its widest diameter and across the single turning tab.

Figure 18D:
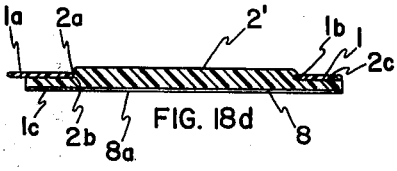

FIG. 18*d* is a sectional view of the engaged rotatory ring of FIG. 18*c* in proper engagement with the flat, outer annular portion of the stationary component showing at the lower section the adhesive part thereon.

Figure 18E:
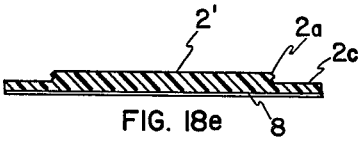

FIG. 18*e* is a sectional view of the stationary component cut across its widest diameter, at the bottom section of which is shown the adhesive portion.

Figure 18F:
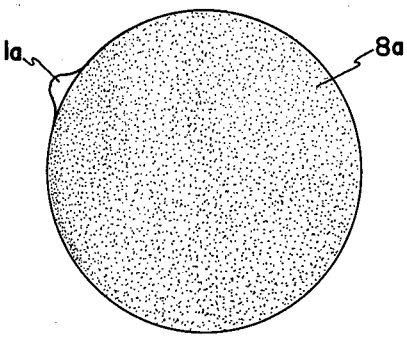

FIG. 18*f* is a bottom plan view of FIG. 18*a* showing the adhesive face and the protruding singular turning tab.

Figure 18G:
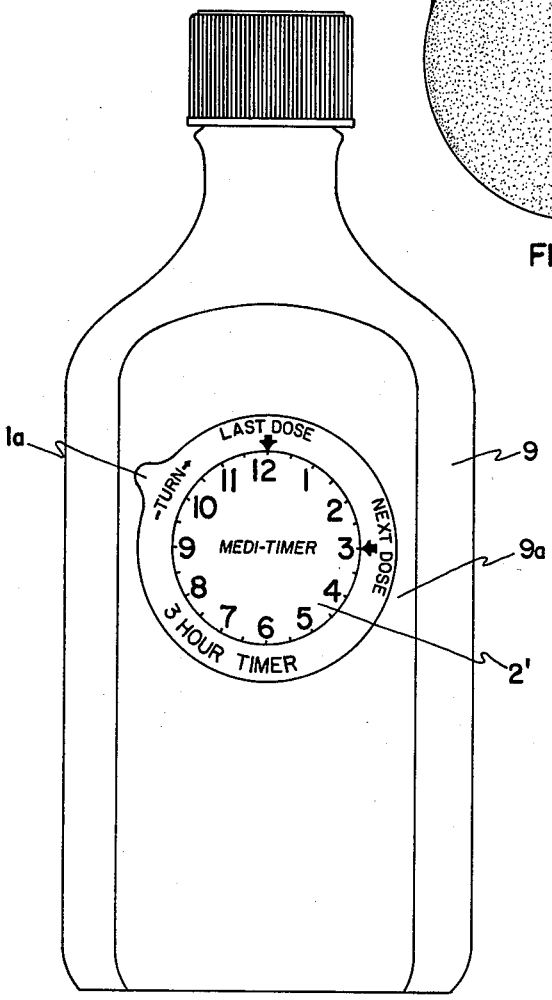

FIG. 18*g* is the same device as shown in FIGS. 18*a*, 18*d*, and 18*f* and adhesively attached to the flat surface of a medicine bottle.

Figure 18H:
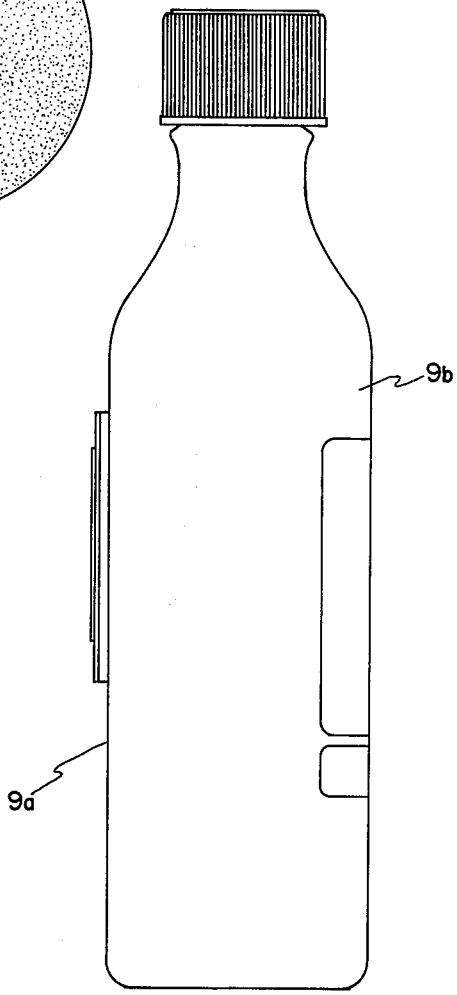

FIG. 18*h* shows the side view of the same modified medication-time-intake reminder as applied to the bottle also shown in side view.

Figure 19:
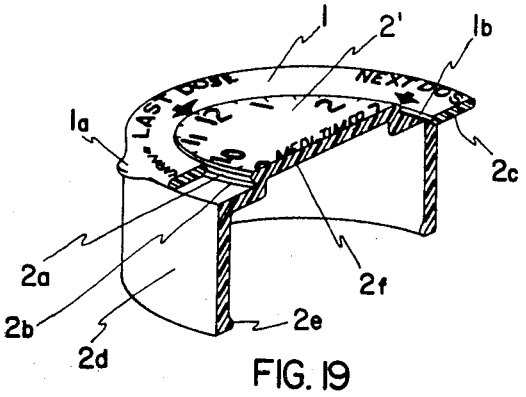

FIG. 19 is another perspective cut away view of the "3-HOUR TIMER" medication reminder showing the combined top view and side view in a partial manner. This view also shows the non-symmetrical cut sections of the rotatory ring thereby exposing in pictorial form how the ridge of the said ring rides smoothly against the groove of the stationary component; the bottom of the same ring lies flatly against the outer flat margin of the same said stationary component that has a continuously solid annular wall with lower inner circular gripping portion.

Figure 20:
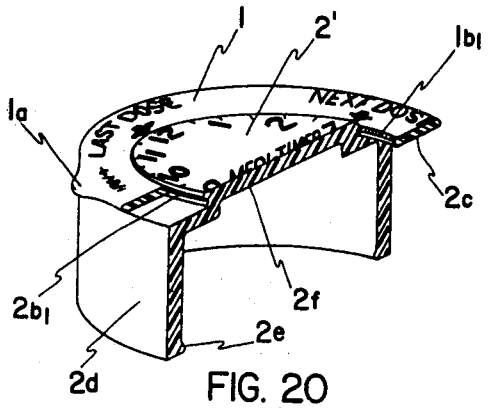

FIG. 20 is the same view as shown in FIG. 19 but the only difference is that there is a modification in the mating relationship between the inner circular ridge of the rotatory ring which in this particular design has structural ribs fitting against the modified ribbed groove of the stationary component.

Figure 21:
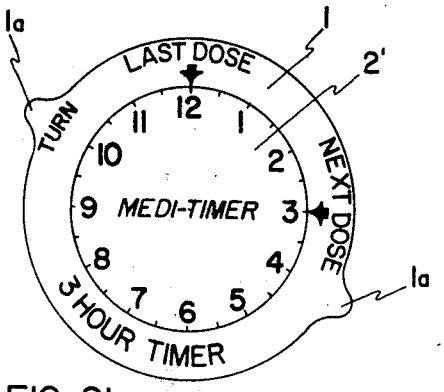

FIG. 21 is a top elevational view of a "3-HOUR TIMER" with proper indicia thereon. The main modification here is the presence of two oppositely located outer protrusions of the rotatory ring for better clockwise turning of the same ring against the stationary circular component.

Figure 22:
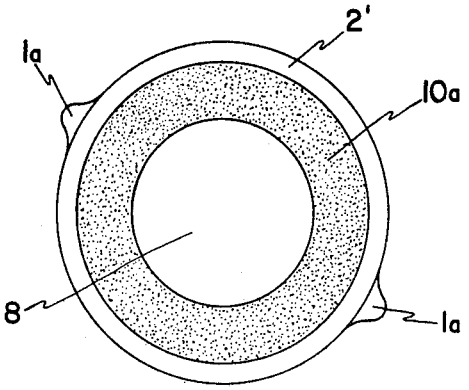

FIG. 22 is a bottom plan view of the same modified device shown in FIG. 21 wherein the bottom part of the stationary portion is flat and attached to it is a double stick doughnut-shaped adhesive for attachment purposes.

Figure 23:
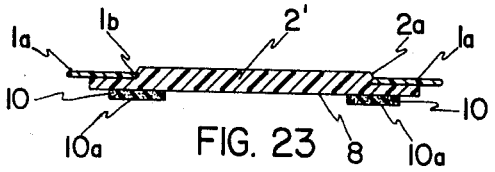

FIG. 23 is the side sectional view of the same modified medication-time-intake reminder showing in section all the main parts of FIG. 21 as cut through the central section of the oppositely positioned turning tab.

Figure 24:
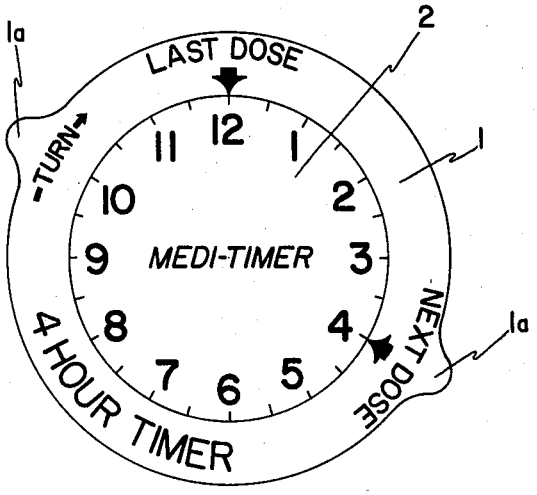

FIG. 24 is a top elevational view of the "4-HOUR TIMER" medication-time-intake reminder of the type as shown in FIG. 23.

Figure 25:
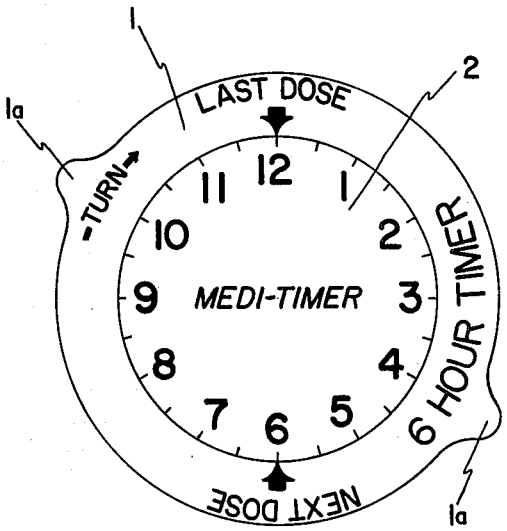

FIG. 25 is a top elevational view of the "6-HOUR TIMER" medication-time-intake reminder, again, of the same adhesively attachable type as shown in FIG.

23 and with proper indicia specially for six-hour interval.

Figure 26:
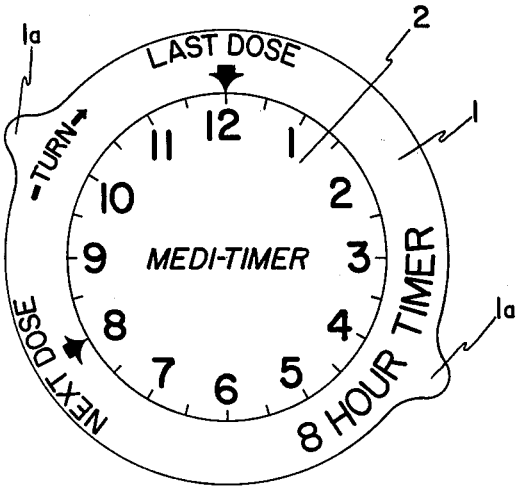

FIG. 26 is a top elevational view of the same medication-time-intake reminder of the type as shown on FIG. 23 with proper eight-hour clockwise interval spacing between the "LAST DOSE" arrow indicia and the "NEXT DOSE" arrow indicia.

Figure 27:
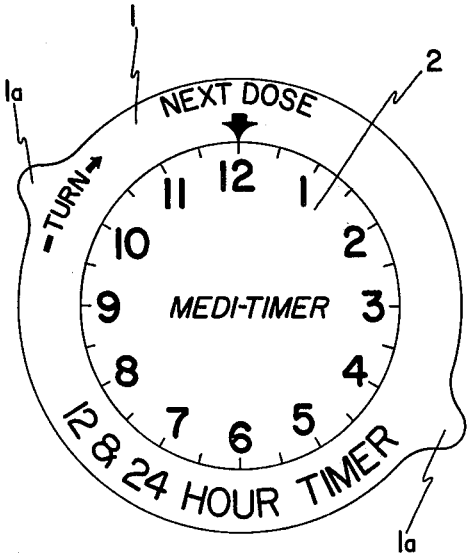

FIG. 27 is the same top elevational view of the medication-time-intake reminder, but this time, only the "NEXT DOSE" arrow indicia with its corresponding word markings and the corresponding "12 & 24-HOUR TIMER" indicia are marked thereon.

FIG. 28 is a top elevational view of a "3-HOUR TIMER" medication time-intake reminder wherein the rotatory ring has three equally spaced outer protrusions favoring greater manipulative capabilities for turning clockwise against the inner clocklike stationary component. All relevant indicia are also printed or marked.

FIG. 29 is a perspective view of the adhesively attachable "3-HOUR TIMER" medication-time-intake reminder shown to be firmly attached on top of a circular pillbox.

FIG. 30 is a sectional view of the same drawing shown on FIG. 29 cut across the central portion passing through the central part of the singular turning tab. This view shows the main component of the said device as attached to the top portion of the pill-box also shown in section.

FIG. 31 is a perspective view of the adhesively applied medication-time-intake reminder of a "3-HOUR TIMER" type attached over another kind of specially designed rotatably locking and unlocking medicine cap fitted around the corresponding medicine container.

FIG. 32 is a perspective view of a "3-HOUR TIMER" medication-time-intake reminder cap that is directly covering the open end of the corresponding medicine container.

FIG. 33 is a sectional view of the same structure shown in FIG. 32 cut across the turning tab through the center and showing the direct screw-type attachment over the corresponding screw threaded outer section of the medicine container shown partly.

FIG. 34 is a sectional view of a modified medication-time-intake reminder cut across the central portion and showing the snap-on gripping engagement with the outer ridge of the open section of the medicine container partly shown.

Figure 35:
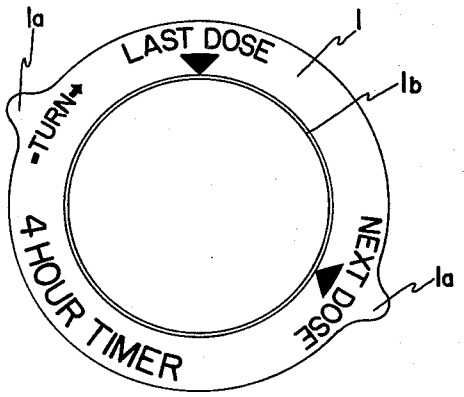

FIG. 35 is a top elevational view of the "4-HOUR TIMER" rotatory ring with two oppositely positioned outer turning tabs.

Figure 35A:
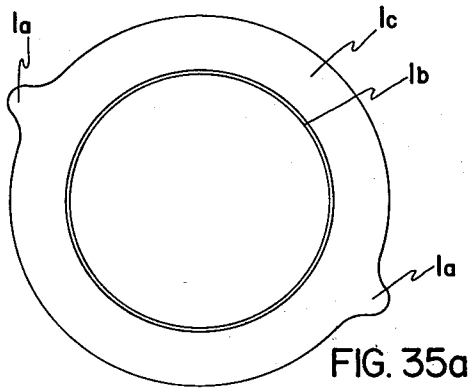

FIG. 35*a* is a bottom plan view of the same ring shown in FIG. 35.

Figure 35B:
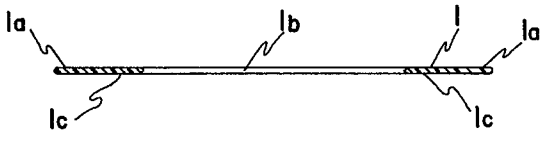

FIG. 35*b* is a sectional view of the same ring as in FIG. 35 and FIG. 35*a* cut across the central part of the oppositely positioned outer turning tabs.

Figure 36:
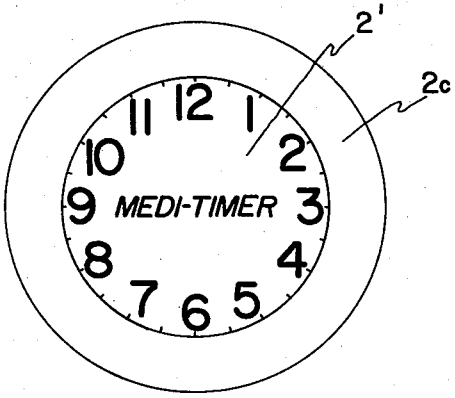

FIG. 36 is a top elevational view of the stationary component of the device showing clock-like inner face.

Figure 36A:
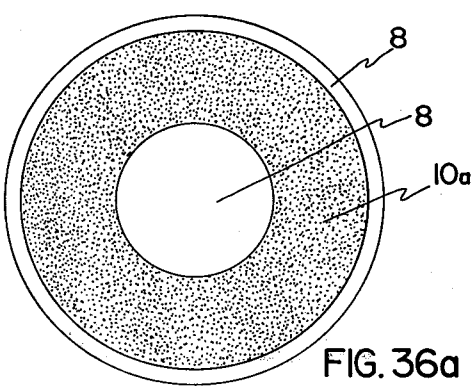

FIG. 36*a* is a bottom plan view of the modified flat medication-time-intake reminder having a double stick centrally located doughnut-shaped adhesive portion.

Figure 36B:
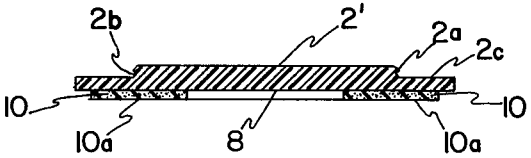

FIG. 36*b* is a cross section of the same structure shown in FIG. 36 and FIG. 36*a* cut across the widest diameter.

Figure 37:
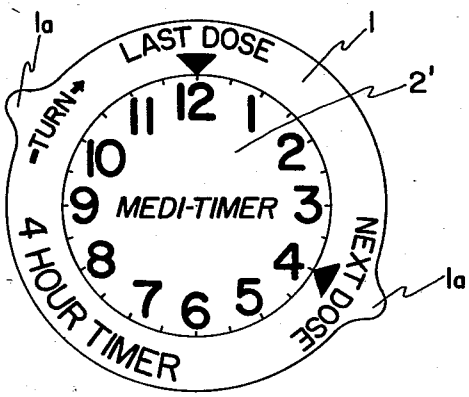

FIG. 37 is a top elevational view of the "4-HOUR TIMER" medication-time-intake reminder with double oppositely positioned turning tabs at its outer rotatory ring and properly engaged with the inner circular flat face of the clocklike stationary component.

Figure 37A:
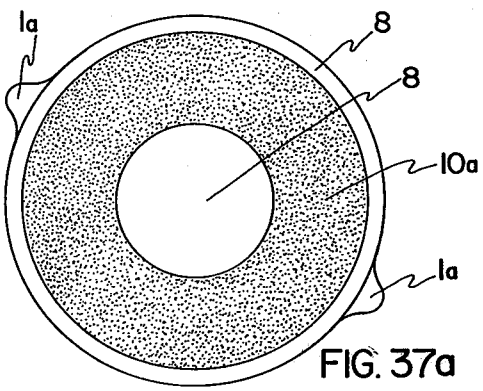

FIG. 37*a* is a bottom plan view of FIG. 37 showing the flat bottom of the stationary component and the two oppositely protruding turning tabs with the centrally located double stick doughnut-shaped adhesive portion.

Figure 37B:
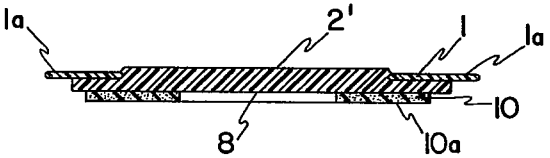

FIG. 37*b* is a cross sectional view of the structures shown in FIG. 37 and FIG. 37*a* cut across the central portion of the oppositely portioned turning tabs and showing all the important components for the said modified device.

Figure 38:
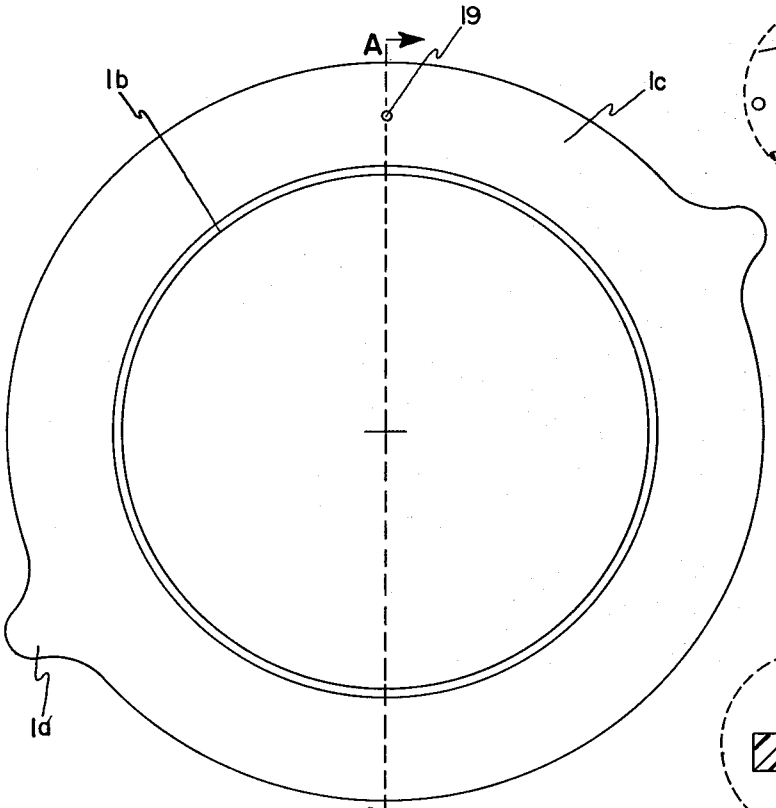

FIG. 38 is an enlarged bottom view of the rotatory ring with dual turning tabs and especially showing at the bottom face, a small protuberance that is optimally located so as to correctly align with the "LAST DOSE" arrow indicia located at the top face of the same ring.

Figure 38A:
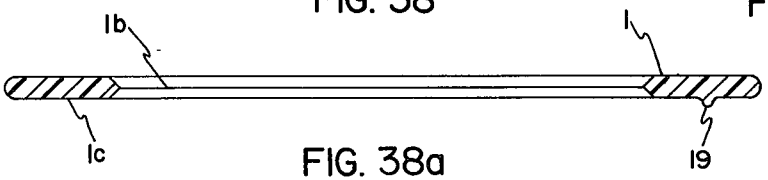

FIG. 38*a* is an enlarged sectional view of the rotatory ring illustrated in FIG. 38 cut across broken line A—A.

Figure 39:
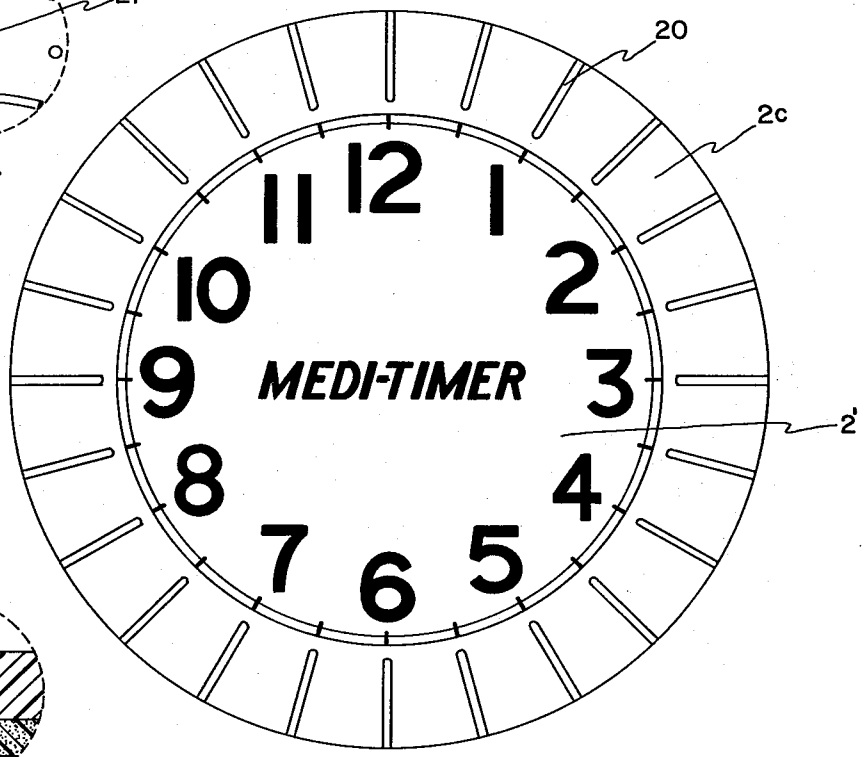

FIG. 39 is an enlarged top elevational view of the clock-like stationary component showing the numerical indicia and equidistantly spaced grooves crossing the face of the circularly running outer portion of the same stationary component.

Figure 39A:
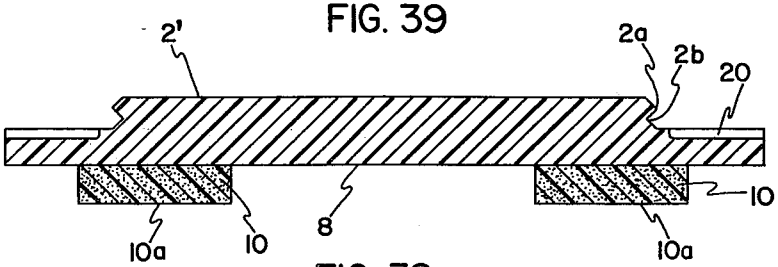

FIG. 39*a* is an enlarged sectional view of the clock-like stationary component shown in FIG. 39 cut across its widest diameter and parallel and through the center of the pair of oppositely positioned grooves.

Figure 40:
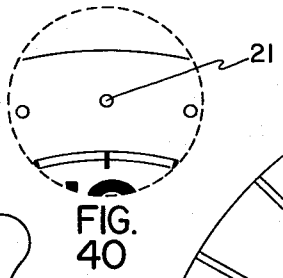

FIG. 40 is an enlarged fragmentary view encircled by broken lines taken from the outer portion of the stationary component above the numerical indicia that indicates 12:00 o'clock and showing at the said outer face 2*c* the corresponding mating concave circular depression that can match in engaging relationship with the protuberance as shown in FIG. 38. In this drawing the said concave circular depression replaces the radiatingly running elongated uniform grooves found at the outer circularly running portion of the said stationary component shown in FIG. 39.

Figure 41:
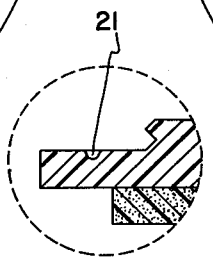

FIG. 41 is an enlarged fragmentary sectional view encircled by broken lines. This also illustrates specifically the same concave depression 21 shown in FIG. 40.

DETAILED DESCRIPTION

Referring to FIGS. 1 thru 3*a*, a rotatory annular ring 1 of the instant invention is shown having indicia thereon. An outer protuberance 1*a* is located on annular ring 1 to aid in turning or rotating the ring. An inner annular ridge 1*b* is provided to engage and receive the ring 1 relative to stationary central portion and allow for rotatory or relative sliding movement thereof. Underside flat surface 1*c* of the annular ring can be seen in juxtaposed position to top flat surface 2*c* of stationary portion 2 in FIG. 2*a* which further includes a depending annular wall 2*d* and gripping annular protuberance 2*e* to aid in gripping over an existing medicine cap. The bottom side of the stationary portion 2 has a roof portion 2*f*. At the top side edges is provided an annular ridge 2*a* and an annular groove 2*b* which cooperate to receive and hold ring member 1 in a snap-fit arrangement whereby the ring member 1 can be rotated and the desired indicia located or positioned relative to stationary component 2.

The materials from which the respective elements are formed are preferably yieldable to the extent normally inherent in plastics and any known or conventional plastics material may be used in this invention.

Various time intervals printed on annular ring member 1 are shown at FIGS. 4 thru 6, to be used with stationary component of FIG. 3*a*, depending upon the desired or prescribed time interval for the medication. In addition to numerical indicia, color coding may be used to distinguish different timer rings according to applicability for effective use in systematic as well as specific time interval of dosage administration of multiple medications. FIGS. 4a thru 6a show the annular ring member coupled to the stationary component and the cooperation of the indicia with respect to each component.

At FIG. 7 is shown the perspective combined top and side elevation view of the snap fitting medication reminder having a continuous annular lateral wall 2d. FIG. 8 shows the elevational sectional view of the medication reminder as attached to a medicine container 4 having an existing cap 3. The medication reminder is shown to be snap-fitted to the medicine bottle cap. At FIG. 9 is shown a perspective cut-away view of FIG. 7 exposing all combined elements in their proper interrelationship.

An alternative means of attaching the medication reminder is shown at FIGS. 10 thru 13b wherein the stationary component 2 is provided with internal screw threads $2d_2$ and external screw threads $2d_1$ on annular depending wall 2d for engagement with a special kind of reversible existing screw-on medicine cap.

In FIG. 13 is shown element 6 which is the external screw thread portion of the said special kind of medicine cap that is capable of engaging with the internal screw thread portion $2d_2$ of FIG. 13b. In FIG. 13a is shown element 5 which is the internal mating screw thread portion of the said existing medicine cap capable of engaging with the external screw thread portion $2d_1$ of FIG. 13b.

A further alternative means of attaching the medication reminder is seen at FIGS. 14 thru 14b wherein the stationary component 2 is provided with a plurality of equidistantly spaced depending walls 7. The spacing 7a between the walls 7 exposes the existing part of the medicine cap so as to provide an additional gripping surface for the user's hand or fingers during the opening of the medicine container.

The drawing FIGS. of 15 thru 17a are similar to FIGS. 1 thru 3a with the exception that the rotatory ring member 1 does not have the "LAST DOSE" indicia since it is to be used as a 12 or 24 hour reminder.

A further alternative means of attaching the medication reminder of the present invention is shown at FIGS. 18 thru 18h wherein the stationary component 2' is provided on its bottom surface with a pad 8 coated with adhesive 8a. The pad 8 can be of elastomeric foam such as polyurethane, or the like, and having a coating or layer of pressure-sensitive adhesive thereon. The adhesive coating may be provided with a conventional protective, peelable sheet member, not shown. A modified form of the pad and adhesive is shown at FIGS. 21 thru 23, 35 thru 37b wherein the pad 10 and adhesive 10a are annular in form.

At FIGS. 19 and 20 is shown modified forms of the respective ridge and groove arrangement of the two elements to allow for a snap-fit and easy rotation of the ring member. FIG. 19 shows a conventional smooth rail type ridge and groove for easy sliding and FIG. 20 shows cooperating teeth elements on the respective elements to allow for a locking or incremental type movement of the annular ring member.

A plurality of tabs 1a can be used with any of the timed medication reminder devices as shown at FIGS. 24 thru 28 to provide additional gripping portions to aid in turning of the outer annular ring member.

At FIGS. 29, 30 is shown the medication reminder adhesively attached to a pill-box container 11 of the conventional type.

At FIG. 31 is shown the medication reminder adhesively attached on top of 13 which is a specially designed currently used locking and unlocking medicine cap with an alignable turning tab to correspond with 12a portion of 12 which is a firmly attached component to the outer periphery of the mouth of the medicine container.

At FIG. 32 is shown in perspective view another alternative design of the medication reminder having solid annular wall 16, that is engaged directly over the medicine container 4.

At FIG. 33 is shown a screw threaded portion 16a located at the inner section of annular wall 16 shown engaged with the corresponding external screw thread of the upper outer periphery of the mouth of the medicine container.

At FIG. 34 is shown another variation of the medication reminder in direct snap-fitting relationship with an annular lip 15 of the medicine container 4. 14 is its short annular wall with outer extension 14a which is for easy removal of the said snap-fitted medication reminder.

At FIG. 35 is shown the rotatory ring component having a dual oppositely located turning tabs 1a and inner annular ridge 1b. All indicia are printed on the top face 1. At FIG. 35a is shown the same rotatory ring showing the bottom face 1c and the same inner annular ridge 1b and dual tabs 1a. At FIG. 35b are shown all components 1, 1a, 1b and 1c in cross sectional view.

At FIG. 36 is shown the top elevational view of the stationary component illustrating the inner flat circular clocklike portion 2' with proper numeral indicia markings from 1 thru 12 and interspaced equally between each successive numerals; 2c is the flat annular outer portion of the same stationary component. At FIG. 36a is shown the bottom plan view of the same stationary component. At FIG. 36b is shown all the corresponding elements already described in FIGS. 36 and 36a including the ridge portion 2a and groove portion 2b of the stationary component, and, including the elastomeric material or pad 10 being adhesively attached to the bottom portion of the stationary component, and, said elastomeric material or pad having an adhesive portion 10a shown in FIG. 36b.

At FIG. 37 is shown the top elevational view of the properly engaged rotatory timer ring with the stationary component 2' showing the dual turning tabs 1a and all other associated indicia already described. At FIG. 37a is the bottom plan view of the engaged medication reminder illustrating all elements already described in FIGS. 35a and 36a. At FIG. 37b is shown the cross-sectional view of the same engaged medication reminder of FIGS. 37 and 37a showing all elements described in both FIGS. 35b and 36b.

At FIG. 38 is shown the enlarged bottom plan view of the rotatory ring with dual turning tabs 1a and bottom face 1c and inner annular ridge 1b; also shown is 19 which is a centrally located protuberance at the bottom face 1c, the central point of 19 aligning perfectly with the axial line of the arrow indicia of the "LAST DOSE" located at the opposite face of the rotatory ring.

At FIG. 38a is the enlarged cross-sectional view of FIG. 38 taken from broken line A—A of FIG. 38 exposing the elements 1a which is the top face of the rotatory ring, 1c which is the bottom face of the same rotatory ring and 19 which is one preferred form of protuberance emanating from face 1c.

At FIG. 39 is shown an enlarged top elevational view of the stationary component 2' having all numeral indicia markings in proper equidistant clocklike spacings between numerals in sequential order from 1 to 12. There are narrow grooves 20 of equal dimensions running in a straight radiating fashion and each of the said grooves being equally spaced between each succeeding ones; said groove exactly corresponding in straightforward alignment with each numeral indicia as well as midpoint between each succeeding numeral indicia ranging from 1 thru 12. In effect when the bottom face 1c of the rotatory ring of FIG. 38a is properly engaged over 2c of FIG. 39, the protuberance 19 of FIG. 38 engages into the groove 20 of FIG. 39 to prevent the undesired accidental slippage between the said rotatory ring from the stationary component during opening of the medicine container.

At FIG. 39a is shown the enlarged sectional view of the stationary component 2' of FIG. 39 straightly cut across its widest diameter parallel to the central axis of the groove, and showing all elements 2', 2a, 2b, 10 and 10a already described; groove 20 is also shown in side view as a result of the abovesaid straight cut across the stationary component.

At FIG. 40 is shown a fragmentary view encircled in broken line taken from a portion of outer sector of the stationary component just above the numeral 12. This illustrates an alternative groove 21 which is circular in configuration and as shown in FIG. 41 said groove is concave in nature thus bringing about the effective accommodation of protuberance 19 of FIG. 38 in snap fitting relationship.

FIG. 41 encircled in broken line shows the said concave groove 21 and, this drawing is taken from a portion of the stationary component. There can be alternative ways of protuberance and groove combination fittings between the rotatory ring and the stationary component with special designs that can favor the easy clockwise rotation of the said rotatory ring while diminishing the chances of accidental counter-clockwise rotation of said rotatory ring against the stationary component, without departing from the scope and basic ramifications from the ones illustrated in FIGS. 38, 38a, 39, 39a, 40 and 41. Thus, there is no set limitation to this invention based on the said protuberance and groove combination.

For the purpose of universalizing the color of the inner clocklike face of the stationary component, it is preferred to have it color coded with white, and, the numeral indicia and centering lines on top of each numeral indicia and midpoint between each numeral indicia be marked with another contrasting and easily distinguishable color aside from white; also, it is preferred that all indicia be made large enough and of the type that can easily be readable.

Each individual rotary ring according to the set time-interval spacing is preferred to be color coded with distinguishable differentiating color codes between each other and contrasting in color with the white inner circular flat clocklike face of the stationary component. All indicia marked on the face of the rotatory ring should be easily readable and should be of enough contrasting color difference against the preferrably homogenous basic color code of each respective rotary ring.

Various changes may be made within the purview of this invention in the form, details, proportions and arrangement of parts without departing from the spirit of the invention to those skilled in the art and no undue limitations are to be inferred or implied from the foregoing disclosure.

I claim:

1. A medication dosage time-intake reminder device for a container cap comprising:

a stationary central member having an annular ridge and groove in the top surface thereof and a downwardly depending annular wall, said top surface having time interval indicia thereon;

an outer annular ring member having an annular ridge portion for engagement with said ridge and groove portion in said top surface of said stationary central member whereby said annular ring member may be rotated relative to said top surface;

medication dosage indicating means on the surface of said outer annular ring member whereby upon rotation of said outer annular ring member with respect to said stationary central member, the medication dosage indicating means may be aligned with the time interval indicia to indicate the time of the next dose administration; and;

an annular protuberance on said depending annular wall whereby said protuberance may engage a portion of a container cap and the device can be rigidly retained on said container cap.

2. A medication time-intake reminder device for a container cap as defined in claim 1 wherein:

said depending annular wall has threads thereon whereby the device may be ridgedly fastened to a container cap.

3. A medication time-intake reminder device for use on a container cap as defined in claim 1, and:

said depending annular wall comprises a plurality of equidistantly spaced depending walls for engagement over a container cap and means on said walls for engaging said cap whereby the device is held firmly on said cap.

4. A medication time-intake reminder device for use on a container cap as defined in claim 1, and:

said container cap is of the type used on medicine containers.

* * * * *